United States Patent [19]

Wilson

[11] Patent Number: 4,927,109

[45] Date of Patent: May 22, 1990

[54] WATER SHEDDING DEVICE FOR BOAT COVERS

[76] Inventor: Donald G. Wilson, 9731 Wenonga Rd., Shawnee Mission, Kans. 66206

[21] Appl. No.: 419,795

[22] Filed: Oct. 11, 1989

Related U.S. Application Data

[63] Continuation-in-part of Ser. No. 858,121, May 1, 1986, abandoned.

[51] Int. Cl.[5] ..... E04G 25/00

[52] U.S. Cl. ..... 248/354.3; 248/188.9

[58] Field of Search ..... 248/354.3, 188.9, 188.4, 248/405; 135/88, 89

[56] References Cited

U.S. PATENT DOCUMENTS

| | | |
|---|---|---|
| 277,146 | 5/1883 | Mansfield . |
| 412,199 | 10/1889 | McIlhenny . |
| 763,306 | 6/1904 | Miller . |
| 1,130,497 | 3/1915 | Dunham . |
| 2,504,392 | 4/1950 | Carter . |
| 3,393,846 | 7/1968 | Cannon et al. . |
| 4,340,075 | 7/1982 | Medeiros . |

*Primary Examiner*—Alvin C. Chin-Shue
*Assistant Examiner*—Sarah A. Lechok
*Attorney, Agent, or Firm*—A. Robert Theibault

[57] ABSTRACT

My invention represents an improvement over the prior art show identified in providing a combination of elements which interact in a novel way to exert a positive force to keep the boat cover taut without yielding under the rain or snow load as will happen in the Burns covers 2,390,986 and 2,474,031 as well as Wright 3,106,218. The structure of my device is provided with two end supports, one for contacting the boat floor and the other for bearing against the under side of the boat cover each support has a knurled or roughened end portion which acts as an anti-skid surface to assist the support in remaining in its installed erect condition.

My support device can be easily manually rotated about the central portion to extend its length and assure positive engagement with the cover and boat floor.

4 Claims, 2 Drawing Sheets

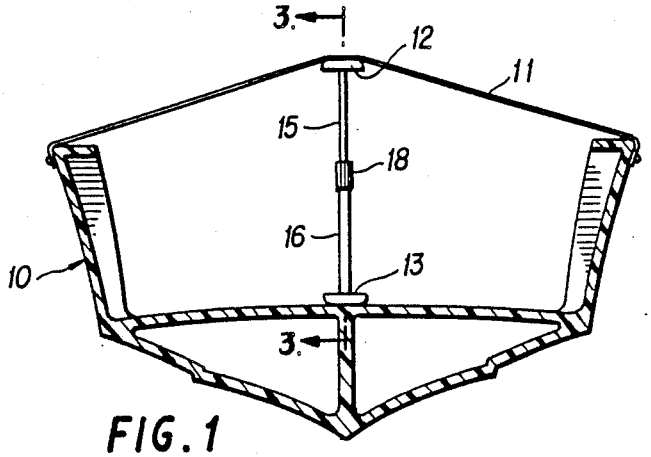
FIG. 1
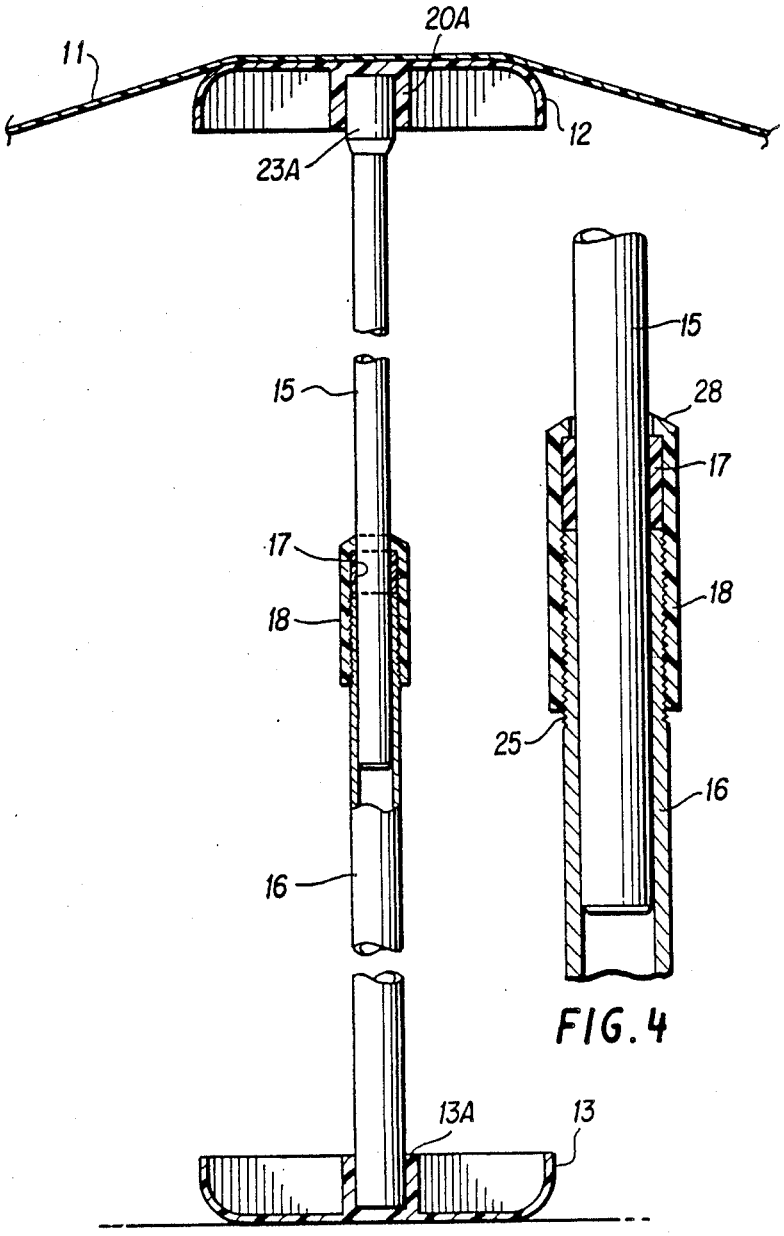
FIG. 3
FIG. 4
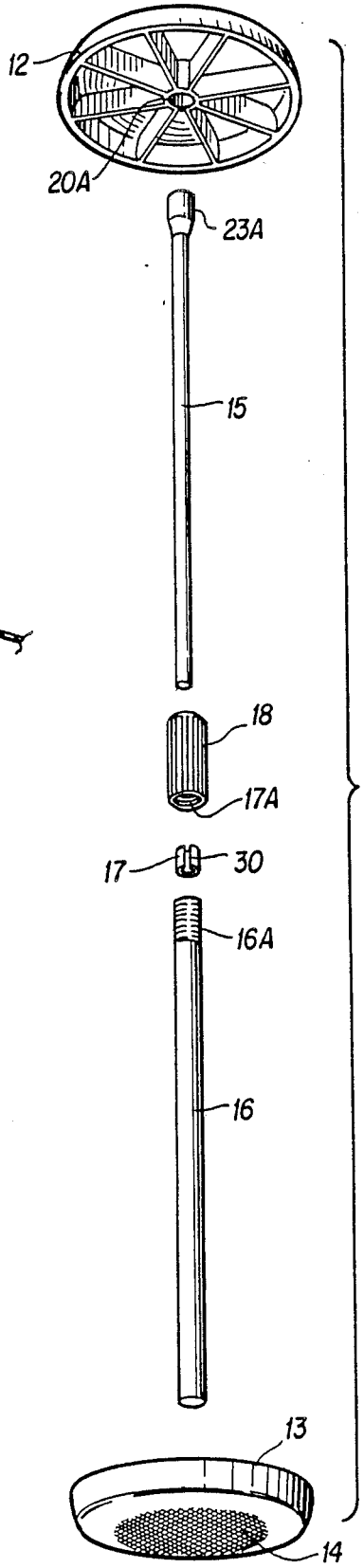
FIG. 2

WATER SHEDDING DEVICE FOR BOAT COVERS

This application is a continuation-in-part of my similarly entitled application Ser. No. 06/858,121, filed May 1, 1986, now abandoned.

BACKGROUND OF THE INVENTION

Many boats are left in the water year round and require covering of their cockpits. Water and snow collects on the cover and weights it down resulting in frequent flooding of the boat.

Numerous patents have been granted for devices which cause the boat cover to be raised or peaked to cause water and snow run-off such as those shown in U.S. Pat. Nos. 277,146; 2,390,986; 2,474,031 and 3,106,218. Supports for tent-like structures are also shown in U.S. Pat. Nos. 2,988,096; 3,106,218 and 4,340,075, all of which constitute the best art known to me as of the filing date of this application.

BRIEF DESCRIPTION OF THE DRAWINGS

FIG. 1, is a transverse section through a boat hull having a cockpit water cover secured thereover and the water shedder device of the present invention installed there within.

FIG. 2, is an exploded perspective view of the water shedder device of the present invention.

FIG. 3, is an enlarged sectional view taken on the lines 3—3 in FIG. 1, with parts broken away and parts shown in section taken at an enlarged scale.

FIG. 4, is an enlarged fragmentary sectional view through the area of the compression member and the telescopic variable length inner and outer support members.

BEST MODES FOR CARRYING OUT THE INVENTION

Figure 5:
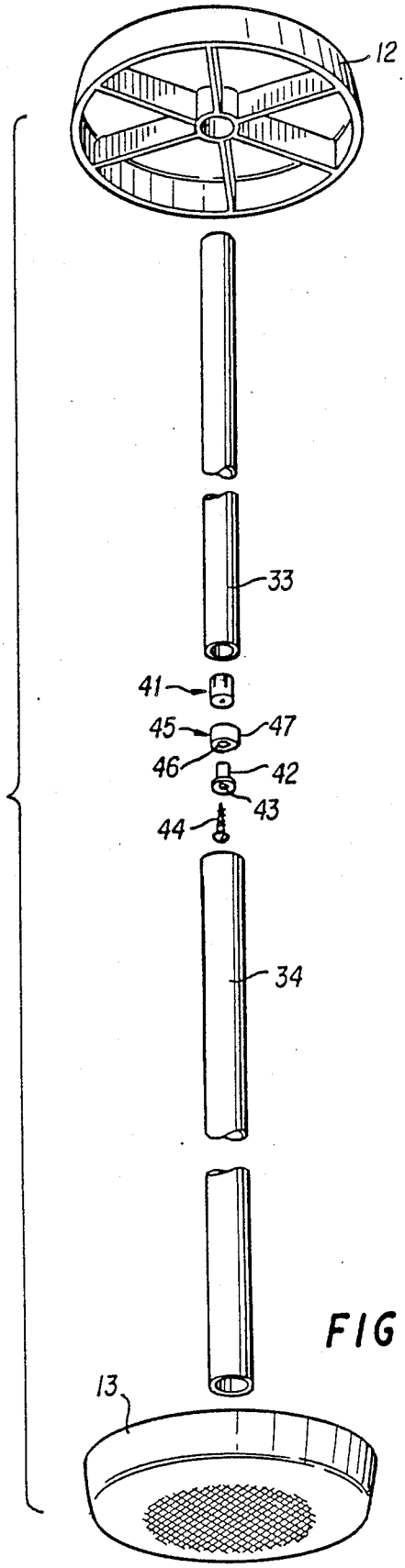
FIG. 5, is an exploded perspective view of a modified form of water shedder device of the present invention.

Referring now to FIGS. 1 through 4, 10 designates a boat hull over which has been secured a cover 11 secured in a known manner to the boat hull and cover art.

Referring now to FIGS. 1 through 4, my device has a head 12 and foot 13 of similar mushroom-like design and which may be of a molded plastic each having a checkered surface area 14 forming a non-skid design which permits the free standing of the device shown in FIGS. 1 and 3.

As best seen in FIGS. 2 and 3, the head 12 and foot 13 are spaced apart in a peaked condition by a pair of telescopic variable length inner and outer tubes 15, 16. One end of the outer tube 16 is externally threaded at 16A to receive an externally fluted compression member 18 having internal threads 17A which mate with threads 16A on the outer telescopic tube 16. The upper end of the fluted compression member is of truncated conical construction at 28 defining a chamber into which is fitted a split resilient compression ring 17, which because of its split 30 can be compressed against the inner tube 15 to arrest relative movement between the inner and outer tubes 15, 16 to fix the peaked height of the boat cover 11. Each end 15A, 16A are smooth and received in smooth boss sockets 20A and 13A of the mushroom-like head and foot members 12, 13 respectively.

When the telescopic tubes 15, 16 are at the right extension to peak the cover as shown in FIGS. 1 and 3 the fluted compression member 18 is rotated to lock the inner and outer tubes 15, 16 into the position by compression of the split ring 17 so that no further relative movement between the inner and outer tubes 15, 16 can take place.

Figure 6:
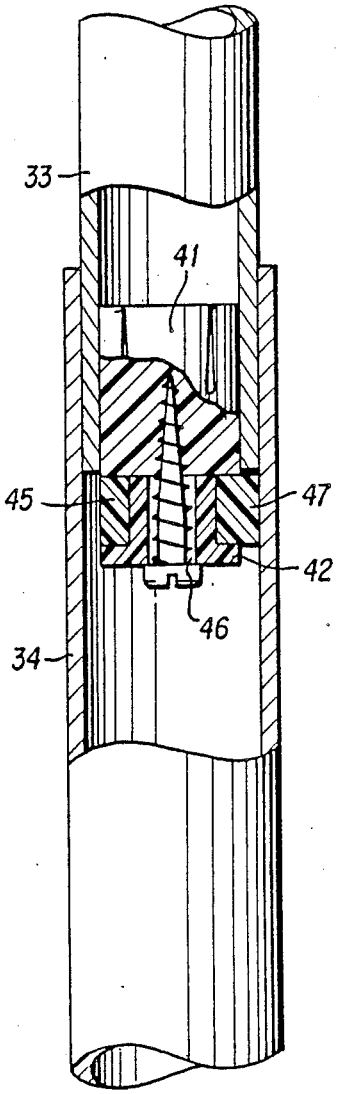
FIG. 6, is an enlarged vertical sectional view taken through the joint between the inner and outer cover supports of FIG. 5.

Another embodiment of my invention is shown in the apparatus of FIGS. 5 and 6 and is for use with a boat hull having a cover secured over the cockpit simular to FIG. 1, the apparatus is adapted to be placed between the underside of the cover and the floor of the boat to form a peaked cover to shed rain and snow off the boat cover to prevent collapsing of the cover under the weight of collected rain or snow thereon.

The boat cover water shedding device has a pair of boat cover and floor engaging members 31, 32. A pair of hollow concentric telescopic variable length inner and outer support members 33, 34, having a hollow chamber 35 in the end of the inner member 33. The cover and floor engaging members 31, 32 are of mushroom shape having smooth bore bosses 36, 37. The stem portion of the mushroom shape 31, 32 are adapted to receive one end of said inner and outer support members 33, 34. The portion of the cover and floor engaging mushroom-like members which are adapted for engagement with said floor 38 and cover 39 have checkered like roughened gripping surface 40 to form an anti-slip surface between the support rod 33, 34, cover 39 and boat floor 38. A split compression plug 41 is placed in one end of one of said variable length support member 33. A hub 42 has an opening 43 therethrough and is anchored in the split compression plug 41 off set in the end of said inner support member 33 by screw 44. An eccentric cam 45 has an axial bore 46 therethrough which is receivable over the hub 42 and is freely rotatable thereabout. The external surface of said eccentric cam 45 has a radially extending lobe 47 which is engageable with the internal surface of the outer support member 34 so that upon adjusting the height of said cover support members one may by counter rotation of the inner and outer support members 33, 34 lock the lobe 47 of eccentric cam 45 against the inner surface of the outer support member to arrest relative axial movement between support members 33, 34 to maintain a peaked condition of the cover 39 to shed off rain and snow from the cockpit.

What I claim is:

1. For use with a boat hull having a cover secured over the cockpit an apparatus adapted to be placed between the underside of the cover and the floor of the boat to form a peaked cover to shed rain and snow off the boat cover to prevent collapsing of the cover under the weight of collected rain or snow thereon, a boat cover water shedding device comprising a pair of boat cover and floor engaging members, a pair of telescopic variable length inner and outer support members, one end of the outer one of said variable length support members being externally threaded, the other ends of each variable length support members being smooth, said cover and floor engaging members being of mushroom shape having smooth bore bosses in the stem portion of the mushroom shape adapted to receive one end of said inner and outer support members, the portion of said cover and floor engaging mushroom-like members adapted for engagement with said floor and cover having checkered-like roughened gripping surfaces to form an anti-slip surface between the support rod, cover and boat floor, an externally fluted compression member having internal threads receivable over the externally threaded end of one of said variable length support members and a truncated conical cap defining a chamber at one end and being threaded at its other end complemental to the threads on the outer one of said variable length support members, and a split compression ring in said chamber receivable over the inner one of said telescopic members so that upon rotating said externally fluted compression member the split compression ring will be compressed to arrest relative movement between said telescopic variable length inner and outer support members to maintain a peaked condition of said cover to shed off rain and snow from said boat cockpit.

2. For use with a boat hull having a cover secured over the cockpit, an apparatus adapted to be placed between the underside of the cover and the floor of the boat to form a peaked cover to shed rain and snow off the boat cover to prevent collapsing of the cover under the weight of collected rain or snow thereon, a boat cover water shedding device comprising a pair of boat cover and floor engaging members, a pair of telescopic adjustable length inner and outer tubular cover support members, having a chamber in the end of said inner tubular member said cover and floor engaging members being of mushroom shape having smooth bore bosses in the stem portion of the mushroom shape adapted to receive one end of said inner and outer support members, the portion of said cover and floor engaging mushroom-like members adapted for engagement with said floor and cover having checkered like roughened gripping surfaces to form an anti-slip surface between the support rod, cover and boat floor, split compression plug means in one end of one of said variable length support members, a hub having an opening along its major axis, said hub being off set relative to the major axis of said inner cover support member being mounted on a disc and being secured to said split plug by an attaching screw passing through the hub opening connecting said hub to said split plug in the end of said inner tubular member, an eccentric cam having an axial bore therethrough receivable over said hub and being freely rotatable thereabout, the external surface of said eccentric cam having a lobe being engageable with the internal surface of said outer support member so that upon adjusting the height of said cover support members by counter rotation of said inner and outer support members the lobe of said eccentric cam will lock the inner and outer members against relative axial movement to maintain a peaked condition of said cover to shed off rain and snow from the boat cockpit.

3. For use with a boat hull having a cover secured over the cockpit an apparatus adapted to be placed between the underside of the cover and the floor of the boat to form a peaked cover to shed rain and snow off the boat cover to prevent collapsing of the cover under the weight of collected rain or snow thereon, a boat cover water shedding device comprising a cover support member defined by a pair of telescopic inner and outer support members having an overlap portion therebetween the outer free ends of said support members being smooth, said cover and floor engaging members being of mushroom shape and having smooth bore bosses in the stem portion of the mushroom shape adapted to receive one of the outer free ends of said telescopic cover support members, the portion of said cover and floor engaging mushroom-like members adapted for engagement with said floor and cover having checkered-like roughened gripping surfaces to form anti-slip surfaces between the support rod to engage the cover and the boat floor, radially extending means having an opening therethrough and being radially expendable about said hub so that upon counter rotating said inner and outer support members the radially extending means will extend and frictionally engage the inner wall of said outer support member to prevent relative axial movement therebetween to maintain a desired length of said support members to maintain a peaked condition of said cover relative to the boat hull to shed off rain and snow from the boat cockpit.

4. For use with a boat hull having a cover secured over the cockpit an apparatus adapted to be placed between the underside of the cover and the floor of the boat to form a peaked cover to shed rain and snow off the boat cover to prevent collapsing of the cover under the weight of collected rain or snow thereon, a boat cover water shedding device comprising a pair of boat cover and floor engaging members, a pair of telescopic adjustable length inner and outer cover support members, the outer free ends of said adjustable length support members being smooth, said cover and floor engaging members being of mushroom shape and having smooth bore bosses in the stem portion of the mushroom shape adapted to receive the outer free ends of said inner and outer telescopic cover support members, the portion of said cover and floor engaging mushroom-like members adapted for engagement with said floor and cover having checkered-like roughened gripping surfaces to form an anti-slip surface between the support rod, cover and boat floor, radial extension means carried by one of said adjustable length inner and outer support members so that upon counter rotation of said inner and outer support members said radial extension means will cause a frictional lock between said inner and outer members to prevent axial relative movement between same which arrest relative movement between said telescopic adjustable length inner and outer support members to maintain a peaked condition of said cover to shed off rain and snow from said boat cockpit.

* * * * *